United States Patent [19]

Deering et al.

[11] Patent Number: 4,530,752

[45] Date of Patent: Jul. 23, 1985

[54] OIL SHALE RETORTING PROCESS

[75] Inventors: Roland F. Deering, Brea; Hugh W. Gowdy, Irvine; Arnold E. Kelley, Orange, all of Calif.

[73] Assignee: Union Oil Company of California, Los Angeles, Calif.

[21] Appl. No.: 622,638

[22] Filed: Jun. 20, 1984

[51] Int. Cl.[3] ..... C10G 1/00; C10B 53/06

[52] U.S. Cl. ..... 208/11 R; 201/28

[58] Field of Search ..... 208/8 R, 11 R; 201/28, 201/31, 32; 48/197 R

[56] References Cited

U.S. PATENT DOCUMENTS

| | | | |
|---|---|---|---|
| 3,361,694 | 1/1968 | Deering | 201/29 |
| 3,501,394 | 3/1970 | Lyons | 208/11 R |
| 3,976,558 | 8/1976 | Hall | 208/11 R |
| 3,977,947 | 8/1976 | Pyle | 201/28 X |
| 4,004,982 | 1/1977 | Jennings et al. | 201/29 |
| 4,010,092 | 3/1977 | Deering | 208/11 R |
| 4,069,132 | 1/1978 | Deering | 208/11 R |
| 4,083,770 | 4/1978 | Deering | 208/11 R |
| 4,203,124 | 4/1981 | Wickstrom et al. | 208/11 R X |
| 4,332,669 | 6/1982 | Spars et al. | 208/11 R |
| 4,340,463 | 7/1982 | Harak | 208/11 R |
| 4,366,046 | 12/1982 | Bertelsen et al. | 208/11 R |
| 4,392,942 | 7/1983 | Wallman et al. | 208/8 R X |
| 4,402,823 | 9/1983 | Bertelsen | 201/31 X |
| 4,435,271 | 3/1984 | Deering et al. | 208/11 R |
| 4,446,001 | 5/1984 | Deering et al. | 208/11 R |
| 4,448,668 | 5/1984 | Deering | 208/11 R |
| 4,455,217 | 6/1984 | Reynolds | 208/11 R |

OTHER PUBLICATIONS

Matthews, C. W., "Improvements in Oil Shale Retorts", *Synthetic Fuels from Oil Shale II*, Proceedings of the Institute of Gas Technology Symposium, held Oct. 22–29, 1981, published 1982, pp. 391–405.

U.S. patent application Ser. No. 510,402, filed Jul. 7, 1983, Deering.

*Primary Examiner*—D. E. Gantz
*Assistant Examiner*—Glenn A. Caldarola
*Attorney, Agent, or Firm*—Yale S. Finkle; Gregory F. Wirzbicki; Dean Sandford

[57] ABSTRACT

Oil shale solids are pyrolyzed or retorted by contact with a non-oxidizing recycle gas in a first retorting zone to produce an effluent containing pyrolysis products and pyrolyzed oil shale solids. Liquid and gaseous product hydrocarbons are recovered from the effluent of the first retorting zone. The pyrolyzed oil shale solids are contacted with an oxygen-containing gas in a combustion zone under conditions such that at least a portion of the organic material in the pyrolyzed solids is burned to produce hot, decarbonized solids and a hot flue gas. At least a portion of the gases in the effluent from the first retorting zone is contacted in the substantial absence of molecular oxygen with a portion of the hot, decarbonized solids produced in the combustion zone in the presence of added hydrocarbon-containing fines, preferably oil shale fines, in a second retorting zone such that the gases are heated and the fines are pyrolyzed to produce pyrolyzed fines and pyrolysis products containing gases and vapors. The gases and vapors in the effluent from the second retorting zone are then recycled to the first retorting zone where they serve as the hot, non-oxidizing recycle gas.

17 Claims, 1 Drawing Figure

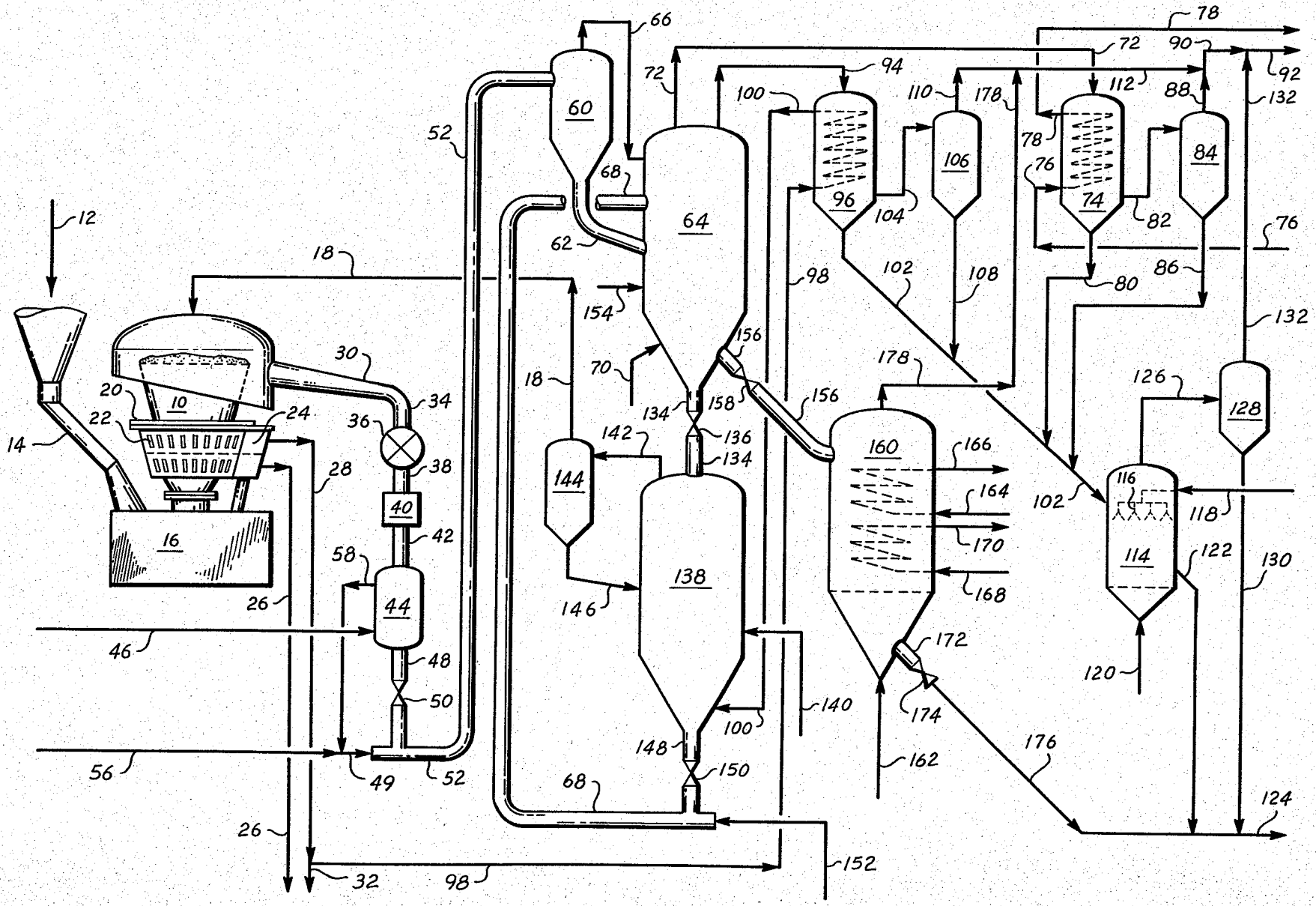

OIL SHALE RETORTING PROCESS

BACKGROUND OF THE INVENTION

This invention relates to the pyrolysis of kerogen-containing oil shale and is particularly concerned with an oil shale retorting process in which the retorted shale is burned to produce hot, decarbonized solids that are used to supply heat for retorting shale fines and for heating recycle retort gas.

Many methods for recovering oil from kerogen-containing oil shale have been proposed in the past. The majority of these methods involve pyrolysis which is commonly referred to as retorting. To be competitive with the production of oils from petroleum stocks, it is essential to recover as much of the heat value from the organic material in the oil shale without incurring prohibitive expense or environmental damage. Normally, oil shale contains between about twenty and about eighty gallons of oil per ton and only a limited proportion can be recovered as product oil or gas. Economical retorting must utilize the remaining heat energy contained in the shale to provide heat for pyrolysis. Sulfur emissions in the gases released from the retorting process, however, must be restricted to low levels required by law while attempting to utilize more of the organic material in the shale.

It is known to retort oil shale by a technique of contacting upward flowing, hydrocarbon-containing solids with downflowing gases in a vertical retort. One such technique is disclosed in U.S. Pat. No. 3,361,644, the disclosure of which is hereby incorporated by reference in its entirety. To produce product vapors, the upward-moving bed of shale particles exchanges heat with a downflowing, hydrocarbonaceous and oxygen-free eduction or retorting gas of high specific heat introduced into the top of the retort at a temperature between about 950° F. and about 1200° F. In the upper portion of the retort, the hot eduction gas pyrolyzes the shale, thereby producing hydrogen and hydrocarbonaceous vapors. In the lower portion of the retort, the eduction gas preheats the ascending bed of shale particles to retorting temperatures. As preheating continues, the eduction gas steadily decreases in temperature, condensing high boiling hydrocarbonaceous vapors into a raw shale oil product while leaving a product gas of relatively high BTU content. The shale oil and product gas are then separated, and a portion of the product gas is heated and recycled to the top of the retort as the eduction or retorting gas.

To minimize the volume of recycled gas required, upflow retorting is usually conducted at pressures above atmospheric with the pressure in the upper regions of the retort normally ranging between about 5 p.s.i.a. and about 100 p.s.i.a., preferably between about 25 p.s.i.a. and about 65 p.s.i.a. The operation of the retort at superatmospheric pressure, however, means that provisions must be made for introducing and recovering particulate shale from the retorting zone without allowing valuable product and recycle gases to depressure. Conventional methods for achieving these objectives use elaborate lock vessels, valves, or slide valves which tend to wear rapidly and produce excessive fines by abrading the shale. Alternatively, liquid sealing devices, such as described in U.S. Pat. No. 4,004,982, have been employed. These devices operate by moving shale particles through a standing head of oil or water, thereby creating a positive back pressure to prevent escape of retort gases. Liquid seals effectively contain retort gases but leave the shale wet. When incorporated into a process for combusting retorted shale in a vessel separate from the retort, use of liquid seals would require the expense of drying the shale prior to combustion.

To increase product yield beyond that which can be educed in the retort alone, processes have been developed to generate product gases by reaction of hot, retorted shale with an oxidizing gas stream, for example, as taught in U.S. Pat. No. 4,010,092, the disclosure of which is hereby incorporated by reference in its entirety. Such gasification reactions conducted in an oxidizing environment, however, burn the coke on the retorted shale at temperatures high enough to release significant amounts of carbon dioxide from decomposing carbonates in the shale. This, in turn, necessitates expensive removal of carbon dioxide from the combustible product gases. Another source of product yield is unretorted shale fines. Oil shale mined for the purpose of retorting in above-ground retorts is usually crushed mechanically to a size suitable for retorting, normally a top size of about 3 inches or smaller. Due to the friable nature of shale, fines ranging in size up to about ⅛ inch are generated in the mining and crushing of larger particles in amounts up to about 10 weight percent of the total shale mined. In above-ground retorting processes, fines mixed with the feed of larger, retort-size particles tend to fill the void spaces between the larger particles. As a result, circulation of hot eduction gases is restricted thus reducing the retort throughput and its oil producing capacity. When the fines are segregated from the feed to the retort to avoid this problem, an appreciable portion of energy available from the shale is wasted.

Retorted shale contains heat energy in the form of coke which can be recovered by passing the retorted shale particles through a combustion zone to burn the coke. Retorted shale, however, generally contains sulfur components and less than complete combustion of the coke generates hydrogen sulfide, which must be removed from the flue gases by means of costly sulfur recovery processes. On the other hand, complete combustion may result in flue gases containing unacceptable quantities of sulfur dioxide. U.S. Pat. No. 4,069,132 discloses a combustion process wherein sulfur dioxide generated during the complete combustion of coke on retorted shale is converted to stable inorganic salts by reaction with alkaline ingredients in the shale. This process utilizes a combustor through which hot retorted shale passes co-currently with air diluted by sufficient flue gas to control peak combustion temperature below about 1670° F. Under such conditions, the discharge of sulfur dioxide from the combustor is disclosed to be greatly reduced.

Because flue gases from combustion zones associated with shale retorts are usually at high temperatures, many retorting processes are designed to utilize the heat contained therein. One example is taught in U.S. Pat. No. 4,069,132, which discloses a process in which hot flue gases are passed in indirect heat exchange with boiler feed water to generate process steam.

Even though many of the above-discussed features have been incorporated into oil shale retorting processes, the need still exists for further developments to improve the efficiency of the processes by effectively retorting raw shale fines using heat generated in the process while controlling the emissions of hydrogen sulfide and other undesirable gases into the atmosphere.

Accordingly, it is one of the objects of the present invention to provide a process for recovering oil and gas from raw shale fines by retorting the fines utilizing the heat contained in decarbonized solids produced by combusting pyrolyzed shale particles. It is another object of the invention to provide a process to heat the recycle retort or eduction gas used for pyrolysis in the retort utilizing the heat contained in decarbonized solids produced by combusting pyrolyzed shale particles. It is yet another object of the invention to utilize decarbonized solids produced by combusting retorted shale particles to remove a large proportion of hydrogen sulfide and carbon dioxide from the gases produced during retorting in order to minimize processing requirements for product gas clean up. These and other objects of the invention will become more apparent in view of the following description of the invention.

SUMMARY OF THE INVENTION

In accordance with the invention, it has now been found that hot, decarbonized solids produced by combusting retorted oil shale solids can be used to directly provide the heat required to pyrolyze hydrocarbon-containing fines, preferably oil shale fines, while at the same time heating the recycle retort gas used to pyrolyze the oil shale feed solids and removing hydrogen sulfide and carbon dioxide therefrom. Kerogen-containing oil shale solids are contacted with a hot, non-oxidizing recycle gas under pyrolysis conditions in a first retorting zone to produce an effluent containing pyrolysis products and pyrolyzed oil shale solids. Liquid hydrocarbons are recovered from the effluent and the pyrolyzed oil shale solids are passed to a combustion zone. Here the pyrolyzed solids are contacted with a gas containing molecular oxygen under conditions such that at least a portion of the organic material remaining in the solids is burned to produce hot, decarbonized solids and a hot flue gas. A portion of the hot, decarbonized solids produced in the combustion zone is then contacted with gases recovered from the effluent of the first retorting zone in the substantial absence of molecular oxygen in a second retorting zone in the presence of added hydrocarbon-containing fines. The heat from the decarbonized solids is sufficient to pyrolyze the hydrocarbon-containing fines to produce pyrolysis products containing gases and vapors and at the same time heat the gases recovered from the effluent of the first retorting zone. The gases and vapors in the effluent from the second retorting zone are then recycled to the first retorting zone for use as the hot, non-oxidizing recycle gas.

In a preferred embodiment of the invention, the gases recovered from the effluent of the first retorting zone are passed in indirect heat exchange with at least a portion of the hot flue gas produced in the combustion zone to preheat the retort gas prior to contacting the gas with a portion of the hot, decarbonized solids produced during combustion. The performance of this additional step results in more efficient use of the heat energy generated in the overall process.

BRIEF DESCRIPTION OF THE DRAWING

The drawing is a schematic flow diagram of a process for retorting oil shale carried out in accordance with the invention.

DETAILED DESCRIPTION OF THE INVENTION

The process depicted in the drawing is one for the retorting of kerogen-containing oil shale solids to produce pyrolyzed solids which are subsequently combusted to provide heat for retorting hydrocarbon-containing fines and heating recycle retort gas. In the process, raw oil shale that has been crushed and screened in a preparation plant, not shown, is introduced into retort 10 through line 12 and feed chute 14. Normally, the shale is crushed such that the feed will not have particles greater than 6 inches in mean diameter and preferably none greater than about 3 inches. The average particle size will normally range between about ⅛ of an inch to about 2 inches in mean diameter. A feeding device located within retort housing 16 forces the shale particles upward into retort 10 at a rate which will vary considerably depending upon the size of the retort, the solids residence time desired therein and the feeding device selected for use. The feeding device may be of any suitable design such as that shown in U.S. Pat. No. 3,361,644, the disclosure of which is hereby incorporated by reference in its entirety. The feeding device, however, is preferably of the design shown in U.S. patent application Ser. No. 194,133 filed on Oct. 6, 1980, the disclosure of which is hereby incorporated by reference in its entirety.

Retorting is carried out in retort 10 in a manner similar to that described in U.S. Pat. No. 3,361,644. The raw shale feed passes upwardly through retort 10 by first traversing a lower preheating zone and then an upper retorting or pyrolysis zone. Temperatures in the lower portion of the retort are sufficiently low to condense product oil vapors from the adjacent retorting zone. As the shale progresses upwardly through the retort, its temperature is gradually increased to retorting levels by contact with countercurrent eduction gases introduced into the top of the retort through line 18. The eduction gas comprises a preheated portion of the product gas produced in retort 10. Retorting temperatures will normally vary between about 800° F. and about 1100° F., and will preferably range between about 900° F. and about 1000° F. The pressure in the retort may be either subatmospheric, atmospheric or superatmospheric, but will normally range between about 5 p.s.i.a. and about 100 p.s.i.a., preferably between about 25 p.s.i.a. and about 65 p.s.i.a.

The recycle gas is introduced into the retort through line 18 at a temperature and flow rate sufficient to heat the crushed shale to retorting temperatures. The temperature of the recycle gas will normally vary between about 950° F. and about 1150° F. The flow rate of the gas will range between about 10,000 standard cubic feet per ton of feed to about 20,000 standard cubic feet per ton of feed shale. The temperature differential between the recycle gas and the shale solids at the top of the retorting zone is normally between about 10° F. and about 100° F.

As the recycle gas passes downwardly through retort 10, it continuously exchanges heat with upwardly moving oil shale. In the upper portion of the retort, hydrocarbon materials contained within the oil shale are educed therefrom by pyrolysis, thereby producing shale oil vapors and fuel gases comprising such normally uncondensable gases as methane, hydrogen and ethane. The shale oil vapors and fuel gases pass downwardly with the recycle gas into the lower portion of the retort wherein the cool oil shale feed condenses the shale oil vapors. Thereafter, the vapors and gases pass into a frusto-conical product disengagement zone 20. This disengagement zone comprises peripheral slots 22 through which liquid shale oil and product vapors flow into surrounding product collection tank 24. The liquid shale oil is withdrawn from the collection tank through line 26 and passed downstream for further processing. The uncondensed vapors and gases are withdrawn from the collection tank into line 28. A portion of these vapors and gases is passed downstream through line 32 for processing to recover light ends oil and water, thereby producing a high BTU product gas which can be sold as a substitute natural gas after removal of small quantities of sulfur and nitrogen-containing impurities.

Retorted or pyrolyzed shale particles are removed from the top of retort 10 through chute 30 and passed through standpipe 34 into star feeder or similar device 36. The pyrolyzed solids are discharged from the star feeder through standpipe 38 into crusher or similar device 40 where the solids are reduced to a top size usually no greater than about ½ inch, normally less than ¼ inch and preferably between about ⅛ and about ¼ inch. The crusher may be any suitable device for reducing the size of the pyrolyzed solids, preferably with a minimum of fines production, that is fluid-tight when operated at the desired crushing pressure. Examples of crushers suitable for use in the process include toothed roll crushers, jaw crushers, cone crushers, hammer crushers and impact crushers. The crusher is operated at any desired pressure that does not cause mechanical breakdown, but is normally operated at the pressure in the retort.

The crushed solids from crusher 40 are passed through standpipe 42 into fluid-tight surge vessel 44 where the solids are maintained in a fluidized state by an inert gas or steam introduced near the bottom of the surge vessel through line 46. The fluidizing gases are introduced at such a rate to maintain the crushed, retorted or pyrolyzed shale particles in a fluidized state while the pressure in the upper region of the surge vessel is balanced so that little if any gas flows through standpipe 42 and crusher 40 either to or from the retort. The balance of pressures in the surge vessel seals the retort and prevents escape of retort gases.

The particles in surge vessel 44 are passed through standpipe 48 and slide valve 50 into lift pipe 52 where they are entrained in gas introduced into the lift through line 49. Normally, the gas introduced into the lift pipe is a mixture of air introduced into line 49 via line 56 and fluidizing gas withdrawn overhead of surge vessel 44 through line 58. The gas is introduced into lift pipe 52 at a velocity and pressure sufficient to raise the crushed, pyrolyzed shale particles to the entrance of cyclone separator or similar device 60. If desired, a portion of the gas supplied to lift pipe 52 through line 49 may be replaced with either steam or an inert gas.

The gas flowing upwardly in lift pipe 52 will contain primarily air but also will include hydrogen sulfide plus sulfur dioxide formed by combustion of gaseous sulfur components entering the lift pipe or by combustion of sulfur-containing gases released from the pyrolyzed shale particles in the lift pipe. The gas will also contain carbon monoxide, hydrogen, and light fuel gases such as methane, ethane and the like. Some of these gases are produced as the pyrolyzed shale particles pass downwardly through standpipe 38, crusher 40, standpipe 42, surge vessel 44 and standpipe 48. The fuel gases may only be partially consumed during combustion in the lift pipe when net reducing conditions are employed. Also, fuel gases may be released from the pyrolyzed particles as they pass through the lift pipe.

The mixture of gas and pyrolyzed shale solids enters cyclone separator 60 where the gas is removed from the solids and passed overhead of the separator through line 66 into the top of fluidized bed combustor or similar device 64. The solids removed from the gas in separator 60 pass downwardly through dip leg 62 into the fluidized bed in combustor 64. The fluidized bed consists of hot solids which extend upwardly within the combustor above an internal grid or similar distribution device not shown in the drawing. Pyrolyzed solids are also introduced into the fluidized bed combustor through line 68. Normally, these pyrolyzed solids will be obtained by retorting finer particles of shale or other hydrocarbon-containing solids external to the combustor as described in more detail hereinafter.

The pyrolyzed solids introduced into the fluidized bed combustor are contacted and fluidized with an oxygen-containing gas introduced into the bottom of the combustor through line 70. A sufficient amount of the oxygen-containing gas, which is preferably air, is introduced into the combustor such that the majority of the organic material in the pyrolyzed particles present in the combustor reacts exothermally with oxygen to form carbon dioxide, carbon monoxide, sulfur oxides, nitrogen oxides and decarbonized solids. The temperature in the combustor will normally be maintained between about 1250° F. and about 1700° F., preferably between about 1300° F. and about 1650° F., while the pressure is maintained at about atmospheric pressure. In general, the combustor is operated so that the maximum amount of heat energy is derived from the combustible materials introduced into the fluidized bed.

The concentration of molecular oxygen in the oxygen-containing gas introduced into combuster 64 will normally range between about 10 volume percent and about 21 volume percent. In general, the oxygen concentration is adjusted to minimize emissions of nitrogen oxides such that below 400 p.p.m.v., preferably below 300 p.p.m.v., of nitrogen oxides are produced. Normally, the combustion in combustor 64 is carried out so that no more than about 20 percent of the organic material that was originally present in the pyrolyzed shale solids removed from retort 10 through chute 30 is present. Preferably, no more than 10 percent remains, most preferably less than 5 percent.

The light hydrocarbon fuel gases introduced into the top of the fluidized bed combuster 64 through line 66 are combusted along with the organic material on the solids in the combustor to supply additional heat energy for the process of the invention. The sulfur oxides in this gas and the sulfur oxides produced within the combustor react with alkaline components of the decarbonized solids in the combustor to produce stable inorganic salts, thereby minimizing the amount of sulfur emissions in the flue gas from the combustor.

The flue gas leaving the fluidized bed in combustor 64 passes through the upper section of the combustor, which serves as a disengagement zone where particles too heavy to be entrained by the gas leaving the vessel are returned to the bed. If desired, this disengagement zone may include one or more cyclone separators or the like for the removal of relatively large particles from the gas. The gas will normally contain a mixture of carbon monoxide, carbon dioxide, unreacted oxygen, nitrogen, entrained fines, and small quantities of sulfur oxides and nitrogen oxides. To best utilize the heat in the flue gas it is normally divided into two streams which are withdrawn separately overhead of the combustor. The first stream is removed through line 72 and passed into steam generator or similar heat exchange vessel 74 where it passes in indirect heat exchange with boiler water introduced into the heat exchanger through line 76. Steam is removed, from vessel 74 through line 78 and passed downstream for subsequent use. Fine particulates which are removed from the flue gas in steam generator 74 exit the vessel through line 80 while the remainder of the gas and entrained fines pass through line 82 into cyclone separator or similar device 84. Here additional fine particulates are removed from the gas through dip leg 86. The gas taken overhead of the separator through line 88 is passed downstream through lines 90 and 92 to a bag house or scrubbing system to remove the last traces of fines before the gas is discharged into the atmosphere.

The second stream of flue gas removed from fluid bed combuster 64 is withdrawn overhead through line 94 and passed into recycle gas preheater or similar heat exchange vessel 96 where the flue gas is passed in indirect heat exchange with a portion of the product gas removed from retort 10 through line 28 and passed into recycle gas preheater 96 via line 98. The recycle product gas is heated from about 200° F. to between about 650° F. and about 950° F. in the recycle gas preheater and is removed from the preheater through line 100. Fine particulates which drop out of the flue gas in the preheater are removed from the bottom of the vessel through line 102 while the cooled flue gas and remaining fine particulates are withdrawn from the preheater through line 104 and passed into cyclone separator or similar device 106 where additional fines are removed through dip leg 108. The cool flue gas containing fine particulates is removed overhead from the separator through line 110 and is mixed with gases in lines 178, 88 and 132 prior to being sent to a bag house or scrubbing system to remove the last traces of fines prior to discharge into the atmosphere.

The fines exiting recycle gas preheater 96 through line 102 are combined with the fine particulates removed from cyclone separator 106 through dip leg 108, the fine particulates removed from heat exchange vessel 74 through line 80 and the fines removed from cyclone separator 84 through dip leg 86. The combined mixture of all these particles is passed through line 102 into fines cooler or similar vessel 114. Here the solids are cooled by contact with water which is introduced into vessel 114 via line 118 and distribution means 116. Air is introduced into fines cooler 114 through line 120 at a rate sufficient to fluidize the fines within the vessel. The amount of water introduced into the fines cooler is regulated such that all the water is vaporized by the heat content of the fines. Decarbonized shale fines essentially free of moisture are removed from the cooler through line 122 and transported to a disposal site through line 124.

A mixture of air, vaporized water and entrained fines is removed overhead of fines cooler 114 through line 126 and passed to cyclone separator or similar device 128. Here the fines are removed from the mixture of water vapor and air and passed downwardly through dip leg 130 into line 124 for transportation to the disposal site. The mixture of water vapor and air is removed overhead of cyclone separator 128 through line 132, mixed with the flue gas in line 90 and passed through line 92 to a bag house or other treatment facility to remove fines.

In a typical prior art process as described above wherein oil shale is retorted by passing it upwardly in countercurrent contact with a downflowing pyrolysis or eduction gas, fine particles in the feed shale tend to fill void spaces between the larger particles during retorting. This increases pressure drop through the retort and may result in maldistribution of the pyrolysis gases as they pass through the bed of shale particles undergoing retorting. Also, a large recycle gas preheater is typically required to heat the recycle pyrolysis gas to a sufficient temperature to effect the pyrolysis in the retort. A preheater of the size required is expensive and the high temperatures necessary in the preheater may result in coking of the heat exchange tubes therein.

It has now been found that large pressure drops in the retort can be avoided by removing fines from the feed material to the retort and separately retorting them in a second retorting zone by contacting the fines with hot, decarbonized solids produced by combusting the retorted shale from the primary retort. In addition, the gas from the recycle gas preheater can be passed into the secondary retorting zone wherein heat from the hot, decarbonized solids also serves to further heat the recycle gas. By supplying heat to the recycle gas in this manner, the temperature at which the recycle gas preheater is operated can be decreased along with the size of the preheater, thereby minimizing coking of the preheater's heat exchange tubes.

Referring again to the drawing, a portion of the hot, decarbonized solids produced in fluidized bed combustor 64 is passed downwardly through transfer line 134 and slide valve 136 into fluidized bed retort 138 where the solids are contacted with hydrocarbon-containing fines introduced into fluidized bed retort 138 through line 140. Both the decarbonized solids and the hydrocarbon-containing fines are maintained in the fluidized state in retort 138 by preheated recycle product gas removed from recycle gas preheater 96 through line 100 and introduced into the bottom of retort 138. The heat from the hot, decarbonized solids produced in combustor 64 is directly transferred to the hydrocarbon-containing fines and the recycle gas in the retort. The heat pyrolyzes hydrocarbon material in the the fines, thereby producing pyrolysis products containing gases and vapors. The recycle gas is further heated to retorting temperatures similar to those required in retort 10.

The fines introduced into retort 138 through line 140 may be raw fines containing organic material that are produced from any hydrocarbon-containing solids. Examples of such fines include fines derived from oil shale, coal, lignite, solid organic wastes, tar sands, petroleum coke and the like. In general, the largest fines will have a $\frac{1}{4}$ inch top size, preferably a $\frac{1}{8}$ inch top size. Normally, the fines will be oil shale fines produced during the mining of the oil shale fed to retort 10. Typically, the amount of fines introduced into retort 138 will be between about 4 and about 10 weight percent of the shale fed into retort 10 through line 12.

In general, sufficient hot, decarbonized solids are passed into fluidized bed retort 138 from combustor 64 such that the temperature of the solids and gases in the retort will range between about 900° F. and about 1200° F., preferably between about 950° F. and about 1150° F. Normally, between about 1.5 and about 4 pounds of hot solids are introduced in the retort for every pound of hydrocarbon-containing fines. The solids residence time in the retort will range between about 2 minutes and about 45 minutes, preferably between about 5 minutes and about 30 minutes. Normally, no air or molecular oxygen is introduced into retort 138 so that the pyrolysis of the hydrocarbon-containing fines and the heating of the recycle gas are carried out in the substantial absence of molecular oxygen. The presence of oxygen in the retort would result in decreased yields of lower quality product from the overall process.

A large majority of hydrogen sulfide and carbon dioxide formed in retort 138 or which is present in the recycle gas introduced into the retort through line 100 will be absorbed by inorganic constituents in the solids undergoing retorting. Normally, the sulfur compounds will react with calcium and magnesium components to form calcium and magnesium sulfide. Heated gas substantially free of hydrogen sulfide and carbon dioxide and containing fine particulates is removed from retort 138 overhead through line 142 and passed to cyclone separator or similar device 144 where the fine particulates are removed and returned to the retort through dip leg 146. The remaining hot gas, normally at a temperature of between about 950° F. and about 1150° F. and substantially free of particulates, is removed overhead from cyclone separator 144 through line 18 and recycled to retort 10 where it serves to supply the heat necessary to educe hydrocarbons from the feed shale introduced into the retort through line 12 and feed chute 14.

The pyrolyzed fines produced in fluidized bed retort 138 by retorting the hydrocarbon-containing fines will contain organic material in the form of coke. In order to utilize this organic material to supply additional heat for the process, the fines are passed from the retort to fluidized bed combustor 64. The pyrolyzed fines are removed in intimate mixture with the decarbonized solids passed into the retort through transfer line 134 from the bottom of the retort through tranfer line 148. The mixture of solids is then passed through valve 150 into lift pipe 68 where the solids are entrained in a stream of air introduced into the lift pipe via line 152. The air carries the mixture of pyrolyzed fines and decarbonized solids through lift pipe 68 into fluidized bed combustor 64 where the coke on the fines is burned. Any calcium and magnesium sulfides formed by absorption of hydrogen sulfide in retort 138 are partially oxidized in the fluidized bed combustor and thereby converted into sulfites and sulfates. The amount of solids circulating from retort 138 into fluidized bed combustor 64 can be adjusted to control the temperature in the combustor.

In some cases, additional fuel may be required for the fluidized bed combustor either during startup or normal operations. If this is the case, the additional fuel in the form of fuel gas, fuel oil, raw oil shale fines, coal fines or any combinations thereof may be introduced into the combustor through line 154.

In general, the heat needed in fluidized bed retort 138 will require only that a portion of the hot, decarbonized solids in fluidized bed combustor 64 be passed through transfer line 134 and valve 136 into the retort. The remaining portion of the decarbonized solids is withdrawn from the bottom of combustor 64 and passed through transfer line 156 and slide valve 158 into cooling vessel 160. Here the decarbonized solids are fluidized with air at ambient temperature introduced into the bottom of vessel 160 through line 162. In the upper portion of the cooling vessel, the hot fluidized solids supply heat indirectly to water introduced into the vessel through line 164 to produce steam which is withdrawn from the vessel through line 166. In the lower portion of cooling vessel 160, boiler feed water is passed into the vessel through line 168 and heated by indirect heat exchange with the decarbonized solids. Preheated boiler water is removed from the lower portion of the vessel through line 170. As a result of this heat recovery, the temperature of the decarbonized shale solids drops from that in the combustor, normally between about 1300° F. and about 1650° F., to between about 300° F. and about 450° F. The residence time in vessel 160 will normally be sufficient to accomplish the above temperature drop while allowing for combustion of some or all of the residual organic material remaining in the decarbonized solids. Normally, the residence time will be between about 20 minutes and about 40 minutes.

The cooled, decarbonized shale solids exit the bottom of cooling vessel 160 through transfer line 172 and valve 174. The cooled solids, which are essentially moisture-free ash, are passed through line 176 and combined with the cooled shale fines in lines 122 and 130 to form a mixture which is sent to a disposal site via line 124. A conventional system for controlling wetting, not shown in the drawing, may form a part of the disposal system. For example, the decarbonized shale particles in line 124 may be sent to a pug mill and therein mixed with water to form a cement type mixture.

Air containing fine particulates is removed overhead of cooling vessel 160 through line 178, combined with flue gas in lines 110, 88 and 132 to form a mixture of gases which is passed through line 90 to a bag house or scrubbing system. Here the fines are removed from the mixture of gases, which is then discharged into the atmosphere.

It will be apparent from the foregoing that the process of the invention provides a method in which raw oil shale fines can be retorted independently of the main retort where the larger shale particles undergo pyrolysis. Because of this, fine particles do not tend to plug the shale bed in the main retort, thereby increasing pressure drop. The vapors generated by the retorting of the shale fines external to the main retort can be added to the volume of recycle gas which in turn will reduce horsepower requirements of the recycle compressor. A large majority of hydrogen sulfide and carbon dioxide in the recycle gas exiting the recycle gas preheater is removed in the vessel in which the fines are pyrolyzed and therefore downstream requirements for product gas clean up are minimized. Coke produced during the retorting of the raw fines is also burned in the combustor to provide additional heat efficiencies for the process. Also, the hot solids produced in the combustor are used to heat recycle gas and therefore the recycle gas preheater requires much less heat exchange surface and lower temperatures. This, in turn, results in less coking of the heat exchange tubes in the preheater.

Although this invention has been primarily described in conjunction with a preferred embodiment, it is evident that many alternatives, modifications, and variations will be apparent to those skilled in the art in light of the foregoing description. Accordingly, it is intended to embrace within the invention all such alternatives, modifications and variations that fall within the spirit and scope of the appended claims.

We claim:

1. A process for retorting oil shale solids which comprises:

(a) contacting said oil shale solids with a hot, non-oxidizing recycle gas comprising gases and vapors from step (e) under pyrolysis conditions in a first retorting zone in the substantial absence of the hot decarbonized solids formed in step (c) to produce an effluent containing pyrolysis products and pyrolyzed oil shale solids;

(b) recovering liquid and gaseous hydrocarbons from the effluent of said first retorting zone;

(c) contacting said pyrolyzed oil shale solids with a gas containing molecular oxygen in a combustion zone under conditions such that at least a portion of the organic material remaining in said solids is burned to produce hot, decarbonized solids and a hot flue gas;

(d) contacting at least a portion of the gases in the effluent from said first retorting zone in the substantial absence of molecular oxygen with a portion of said hot, decarbonized solids produced in step (c) in the presence of added hydrocarbon-containing fines in a second retorting zone such that said gases are heated and said fines are pyrolyzed to produce pyrolyzed fines and pyrolysis products containing gases and vapors; and (e) recovering gases and vapors from said second retorting zone.

2. A process as defined by claim 1 including the additional step of passing said portion of gases in the effluent from said first retorting zone in indirect heat exchange with said hot flue gas produced in step (c) to preheat said portion of gases prior to contacting said portion of gases with said portion of hot, decarbonized solids produced in step (c).

3. A process as defined by claim 1 wherein said gas containing molecular oxygen comprises air.

4. A process as defined by claim 1 wherein said hydrocarbon-containing fines comprises oil shale fines.

5. A process as defined by claim 1 wherein said first retorting zone is maintained at a temperature between about 800° F. and about 1100° F.

6. A process as defined by claim 1 wherein the temperature in said second retorting zone is maintained between about 900° F. and about 1200° F.

7. A process as defined by claim 1 wherein the temperature in said combustion zone is maintained between about 1250° F. and about 1700° F.

8. A process as defined by claim 1 wherein said pyrolyzed fines produced in said second retorting zone are passed to said combustion zone.

9. A process as defined by claim 1 wherein said combustion zone and said second retorting zone contain fluidized beds.

10. A process as defined by claim 1 wherein said oil shale solids are contacted in said first retorting zone with a downflowing stream of said recycle gas as said solids move upward through said retorting zone.

11. A process for retorting oil shale solids which comprises:

(a) contacting said oil shale solids with a hot, non-oxidizing recycle gas under pyrolysis conditions in a first retorting zone to produce an effluent containing pyrolysis products and pyrolyzed oil shale solids;

(b) recovering liquid and gaseous hydrocarbons from the effluent of said first retorting zone;

(c) contacting said pyrolyzed oil shale solids with air in a fluidized bed combustion zone external to said first retorting zone under conditions such that at least a portion of the organic material remaining in said solids is burned to produce hot, decarbonized solids and a hot flue gas;

(d) passing at least a portion of the gases in the effluent from said first retorting zone in indirect heat exchange with at least a portion of said hot flue gas produced in step (c) to preheat said gases;

(e) contacting said preheated gases from step (d) in the substantial absence of molecular oxygen with a portion of the hot, decarbonized solids produced in step (c) in the presence of added oil shale fines in a second retorting zone such that said preheated gases are further heated and said fines are pyrolyzed to produce pyrolyzed fines and pyrolysis products containing gases and vapors; and (f) using the gases and vapors in the effluent from said second retorting zone as said recycle gas in step (a).

12. A process as defined by claim 11 wherein said second retorting zone is a fluidized bed retorting zone.

13. A process as defined by claim 11 wherein said pyrolyzed fines produced in said second retorting zone are passed to said fluidized bed combustion zone.

14. A process as defined by claim 1 wherein said first retorting zone is contained within a first vessel and said second retorting zone is contained within a second vessel separate from said first vessel.

15. A process as defined by claim 11 wherein said first retorting zone is contained within a first vessel and said second retorting zone is contained within a second vessel separate from said first vessel.

16. A process for retorting oil shale solids which comprises:

(a) contacting said oil shale solids with a hot, non-oxidizing recycle gas comprising gases and vapors from step (f) under pyrolysis conditions in a first retorting zone to produce an effluent containing pyrolysis products and pyrolyzed oil shale solids;

(b) recovering liquid and gaseous hydrocarbons from the effluent of said first retorting zone;

(c) contacting said pyrolyzed oil shale solids with a gas containing molecular oxygen in a combustion zone under conditions such that at least a portion of the organic material remaining in said solids is burned to produce hot, decarbonized solids and a hot flue gas;

(d) passing at least a portion of the gases in the effluent from said first retorting zone in indirect heat exchange with said hot flue gas produced in step (c) to preheat said gases;

(e) contacting said preheated gases from step (d) in the substantial absence of molecular oxygen with a portion of the hot, decarbonized solids produced in step (c) in the presence of added hydrocarbon-containing fines in a second retorting zone such that said preheated gases are further heated and said fines are pyrolyzed to produce pyrolyzed fines and pyrolysis products containing gases and vapors; and (f) recovering gases and vapors from said second retorting zone.

17. A process for retorting oil shale solids which comprises:

(a) passing said oil shale solids upward through a first retorting zone in contact with a downflowing hot, non-oxidizing recycle gas comprising gases and vapors from step (e) under pyrolysis conditions to produce an effluent containing pyrolysis products and pyrolyzed oil shale solids;

(b) recovering liquid and gaseous hydrocarbons from the effluent of said first retorting zone;

(c) contacting said pyrolyzed oil shale solids with a gas containing molecular oxygen in a combustion zone under conditions such that at least a portion of the organic material remaining in said solids is burned to produce hot, decarbonized solids and a hot flue gas;

(d) contacting at least a portion of the gases in the effluent from said first retorting zone in the substantial absence of molecular oxygen with a portion of said hot, decarbonized solids produced in step (c) in the presence of added hydrocarbon-containing fines in a second retorting zone such that said gases are heated and said fines are pyrolyzed to produce pyrolyzed fines and pyrolysis products containing gases and vapors; and (e) recovering gases and vapors from said second retorting zone.

* * * * *

UNITED STATES PATENT AND TRADEMARK OFFICE

CERTIFICATE OF CORRECTION

PATENT NO. : 4,530,752

DATED : 07/23/85

INVENTOR(S) : Deering, Gowdy and Kelley

It is certified that error appears in the above-identified patent and that said Letters Patent is hereby corrected as shown below:

Col. 11, claim 3, line 34; claim 4, line 36; claim 5, line 38; claim 6, line 41; claim 7, line 44; claim 8, line 47; and claim 9, line 50, after "claim" delete "1" and insert therefor --14--.

Signed and Sealed this

Tenth Day of November, 1987

*Attest:*

*Attesting Officer*

DONALD J. QUIGG

*Commissioner of Patents and Trademarks*